US010167662B2

(12) United States Patent
Zrnic et al.

(10) Patent No.: US 10,167,662 B2
(45) Date of Patent: Jan. 1, 2019

(54) FRAME ASSEMBLY FOR A DOORWAY

(75) Inventors: Radenko Zrnic, Kings Langley (AU); Donald Walters, Kings Langley (AU)

(73) Assignee: Wombat Timbers Pty Ltd, Revesby (AU)

( * ) Notice: Subject to any disclaimer, the term of this patent is extended or adjusted under 35 U.S.C. 154(b) by 0 days.

(21) Appl. No.: 13/277,823

(22) Filed: Oct. 20, 2011

(65) Prior Publication Data

US 2012/0096783 A1 Apr. 26, 2012

(30) Foreign Application Priority Data

Oct. 20, 2010 (AU) ..... 2010904673

(51) Int. Cl.
*E06B 1/06* (2006.01)
*E06B 3/984* (2006.01)

(52) U.S. Cl.
CPC ..... *E06B 1/06* (2013.01); *E06B 3/984* (2013.01)

(58) Field of Classification Search
CPC ..... E06B 1/06; E06B 1/52; E06B 1/08; E06B 1/68; E06B 3/984
USPC ..... 52/204.1, 204.2, 207, 215, 211, 212
See application file for complete search history.

(56) References Cited

U.S. PATENT DOCUMENTS 346,187 A * 7/1886 Boda ..... E06B 1/02 52/745.15
593,435 A * 11/1897 Roehr ..... E06B 1/20 49/505
985,886 A * 3/1911 Dahlstrom ..... E06B 1/34 292/DIG. 70
1,197,031 A * 9/1916 Kelly ..... 49/505
1,363,887 A * 12/1920 Leonard ..... E06B 1/6038 52/211
1,664,578 A * 4/1928 Thornberry ..... 49/404
1,708,599 A * 4/1929 Andersen ..... 52/204.1
1,837,748 A * 12/1931 Baum ..... E06B 3/9642 52/211
1,864,577 A * 6/1932 Baum ..... E05F 5/06 49/504
2,281,864 A * 5/1942 Toothacre ..... 52/210
2,541,871 A * 2/1951 Heijmer et al. ..... 49/399
(Continued)

FOREIGN PATENT DOCUMENTS

DE 4008889 A1 * 9/1991 ..... B27M 3/00
DE 102012000515 A1 * 7/2013 ..... E06B 3/984
(Continued)

*Primary Examiner* — Brent W Herring
(74) *Attorney, Agent, or Firm* — Benjamin Aaron Adler

(57) ABSTRACT

A frame assembly for a doorway defined by two substantially vertical sides and a substantially horizontal side comprises a header jamb having a top surface, a bottom surface, and one or two header jamb rebates. The top surface of the head jamb is adapted for fixedly mounting to the substantially horizontal side of the doorway and the header jamb rebates located on the bottom surface across the length of the header jamb define a header soffit. The frame assembly comprises two upright jambs each having an outer surface and a top end. The outer surface of each of the upright jambs is adapted for fixedly mounting to one of the two substantially vertical sides of the doorway. The top end of each of the upright jambs have a slot for receiving a portion of the header soffit such that, when assembled, the header soffit engages in the slots.

11 Claims, 7 Drawing Sheets

(56) References Cited

U.S. PATENT DOCUMENTS 2,581,750 A * 1/1952 Bursik ..... E06B 1/18 52/211
2,582,468 A * 1/1952 Sylvan ..... E06B 1/32 52/211
2,619,687 A * 12/1952 Kahn ..... 52/217
2,717,063 A * 9/1955 Sylvan ..... E06B 1/52 52/211
2,799,370 A * 7/1957 Sklar ..... 52/211
2,865,060 A * 12/1958 Pattiani ..... 52/215
2,869,695 A * 1/1959 Herr et al. ..... 52/211
2,898,642 A * 8/1959 Etling ..... 52/210
3,040,390 A * 6/1962 Carlton ..... 52/211
3,082,490 A * 3/1963 Loucks ..... 52/213
3,222,833 A * 12/1965 Woodrum ..... 52/211
3,287,857 A * 11/1966 Dukas ..... 49/504
3,429,076 A * 2/1969 Fortsch et al. ..... 49/504
3,504,465 A * 4/1970 Brinker ..... 52/282.3
3,593,473 A * 7/1971 King ..... E06B 1/16 52/211
3,769,773 A * 11/1973 Mochizuki ..... 52/656.4
3,811,238 A * 5/1974 Brinker ..... 52/211
3,845,604 A * 11/1974 Ottosson ..... 52/204.597
4,067,157 A * 1/1978 Robinson ..... 52/127.2
4,167,088 A * 9/1979 Governale ..... 52/207
4,589,229 A 5/1986 Warren
4,662,112 A * 5/1987 Bursk ..... E06B 7/00 49/380
4,740,098 A * 4/1988 Witt ..... 403/205
4,922,659 A * 5/1990 Muccioli ..... E06B 1/52 49/501
5,115,597 A * 5/1992 Tillery et al. ..... 49/504
5,295,327 A * 3/1994 Dubois ..... 49/504
5,365,708 A 11/1994 Winston
5,546,715 A * 8/1996 Edstrom ..... 52/215
5,581,953 A 12/1996 Ruff
5,619,823 A * 4/1997 Ruff et al. ..... 49/504
5,661,943 A * 9/1997 Hagel ..... 52/656.4
5,832,670 A * 11/1998 Bennett ..... 49/382
5,857,299 A * 1/1999 Gyllenberg et al. ..... 52/217
5,873,209 A * 2/1999 Hagel ..... 52/656.4
5,950,391 A * 9/1999 Hagel ..... 52/656.4
6,079,181 A * 6/2000 Ruff ..... 52/745.15
6,122,882 A * 9/2000 Hagel ..... 52/656.4
6,148,572 A * 11/2000 Ruff ..... 52/204.1
6,192,638 B1 * 2/2001 Wang ..... 52/213
6,530,183 B1 * 3/2003 Kuei-Yung ..... E06B 1/26 49/504
7,100,339 B2 * 9/2006 Hagel ..... E06B 1/06 160/201
RE43,251 E * 3/2012 Anderson et al. ..... 52/204.54
8,178,643 B2 * 5/2012 Edstrom et al. ..... 528/60
2003/0005652 A1 * 1/2003 Hagel ..... E06B 1/06 52/211
2004/0221523 A1 * 11/2004 Hagel ..... E06B 1/06 52/204.1
2005/0193653 A1 * 9/2005 Cornell ..... E06B 1/6023 52/204.1
2006/0096191 A1 * 5/2006 Liu ..... 52/204.1
2008/0178553 A1 * 7/2008 Micho et al. ..... 52/656.4
2009/0183437 A1 7/2009 Chen
2013/0199114 A1 * 8/2013 Ben Ezra ..... E05B 15/0205 52/173.1

FOREIGN PATENT DOCUMENTS

EP 0732459 9/1996
EP 1895088 A1 * 3/2008 ..... E06B 3/96
GB 1165515 10/1969
GB 2342378 4/2000

* cited by examiner

FRAME ASSEMBLY FOR A DOORWAY

CROSS-REFERENCE TO RELATED APPLICATIONS

This application claims the priority, under 35 U.S.C. §§ 119 and 371, of Australian patent application No. 2010904673, filed Oct. 20, 2010; the prior application is herewith incorporated by reference in its entirety.

STATEMENT REGARDING FEDERALLY SPONSORED RESEARCH OR DEVELOPMENT

Not Applicable

FIELD OF THE INVENTION

The present invention relates to manufacturing frame assemblies and in particular to a frame assembly for a doorway.

The invention has been developed primarily for use in frame assemblies for doorways and will be described hereinafter with reference to this application. However, it will be appreciated that the invention is not limited to this particular field of use.

BACKGROUND OF THE INVENTION

Frame assemblies for doorways generally comprise two vertical sections (upright jambs) and a horizontal section (header jamb) that connects the two upright jambs to form a standard door frame or assembly for installation in a doorway. The upright jambs and the header jamb are generally manufactured and sold with either a single or double rebate depending on whether the door assembly is to have one or two door panels fitted. Once purchased, additional rebates are required to be made at either end of the header jamb to accommodate the upright jambs so that the frame assembly can fit neatly within the doorway. However, such additional header rebates are usually prepared onsite using a saw or chisel which oftentimes leads to unsightly saw or chisel marks in the header jamb that subsequently need to be filled or smoothed to ensure a seamless connection with the corresponding upright jamb.

The upright jambs and the header jamb are typically manufactured as a set with each jamb being of generally a fixed dimension in accordance with those of standard doorways. This presents problems in cases where the doorway is not a standard doorway such that one or more of the jambs in the set have the wrong dimensions and new jambs need to be custom built. The one or more jambs remaining in the set are therefore redundant and often left to waste.

Standard doorways also pose difficulties when large or awkward household items such as, for example, furniture or whitegoods, are to be passed through the doorway. Due to the fixed width of standard doorways, such items may require disassembling or some other form of time-and energy-consuming maneuvering to pass the item through the doorway. In other cases, the doorway may also need to be widened to allow, for example, wheelchair access. In cases where the doorway is to be widened, it is necessary to obtain at least a new header jamb to account for the additional width of the doorway. This presents additional problems, as the new header jamb will again need to have additional header rebates cut to accommodate the existing upright jambs.

The present invention seeks to provide a frame assembly for a doorway which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE INVENTION

The invention provides a method for manufacturing frame assemblies and, in particular, to a frame assembly for a doorway that overcome the hereinafore-mentioned disadvantages of the heretofore-known devices and methods of this general type.

Although the invention is illustrated and described herein as embodied in a method for manufacturing frame assemblies and, in particular, to a frame assembly for a doorway, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Additional advantages and other features characteristic of the present invention will be set forth in the detailed description that follows and may be apparent from the detailed description or may be learned by practice of exemplary embodiments of the invention. Still other advantages of the invention may be realized by any of the instrumentalities, methods, or combinations particularly pointed out in the claims.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

According to a first aspect of the present invention, there is provided a frame assembly for a doorway, the doorway being defined by two substantially vertical sides and a substantially horizontal side comprising a header jamb having a top surface, a bottom surface and one or two header jamb rebates, the top surface of the head jamb being adapted for fixedly mounting to the substantially horizontal side of the doorway and the one or two header jamb rebates located on the bottom surface across the length of the header jamb defining a header soffit, and two upright jambs each having an outer surface and a top end, the outer surface of each of the upright jambs being adapted for fixedly mounting to one of the two substantially vertical sides of the doorway, the top end of each of the upright jambs having a slot for receiving a portion of the header soffit such that when assembled the header soffit engages in the slots.

Advantageously, the slot in the top ends of each upright jamb enables the header jamb to be mounted quickly and easily on the upright jambs onsite without needing to prepare additional header rebates in the bottom surface of the header jamb to receive the upright jambs as is required with a standard frame assembly for a doorway.

Advantageously, the slot in the top ends of each upright jamb receives a portion of the header soffit such that the top end of the upright jamb substantially abuts the one or two header jamb rebates on the bottom surface of the header jamb.

Advantageously, in the event the doorway is required to be widened, the frame assembly can be easily disassembled, and the same upright jambs repositioned in the widened doorway, such that all that is required is a longer header jamb to be introduced. This is beneficial as the longer header jamb can be mounted quickly and easily on the repositioned upright jambs onsite without needing to prepare additional header rebates in the bottom surface of the header jamb.

Advantageously, in the event the doorway is required to be narrowed, the frame assembly can be easily disassembled, and the same upright jambs can be repositioned in the narrowed doorway, such that all that is required is a shorter header jamb to be introduced. This is beneficial as the same header jamb can be shortened and then re-mounted quickly and easily on the repositioned upright jambs onsite without needing to prepare additional header rebates in the bottom surface of the header jamb.

Advantageously, the header jamb and the two upright jambs can be provided as a single jamb cut with one or two rebates as is required and then cut onsite to the appropriate lengths of the header jamb and the two upright jambs according to the dimensions of the doorway. This is beneficial as the frame assembly can be manufactured and provided as a single jamb rather than as a set of three separate jambs as is the case with conventional frame assemblies for doorways.

Preferably, each of the upright jambs has an inner surface, a bottom end, and one or two upright rebates in the inner surface extending from the top end to the bottom end, the one or two upright rebates corresponding to the one or two header jamb rebates and having generally the same cross-section.

Preferably, the frame assembly further comprises one or more auxiliary upright jambs disposed between the upright jambs, each of the one or more auxiliary upright jambs having an auxiliary top end, each of the auxiliary top ends having an auxiliary slot for receiving a portion of the header soffit such that when assembled the header soffit engages in the auxiliary slots.

Advantageously, one or more auxiliary upright jambs can be easily introduced to the frame assembly to, for example, divide the frame assembly into two or more openings. This is beneficial if, for example, two or more auxiliary doors are to be installed in the frame assembly, or alternatively, if, for example, an auxiliary door is to be introduced into one of the two or more openings and either a leadlight (not shown) or a solid panel (not shown) is to be installed in the other of the two or more openings.

Advantageously, the auxiliary slot in the auxiliary top end of each of the one or more auxiliary upright jambs receives a portion of the header soffit such that the auxiliary top end of each of the one or more auxiliary upright jambs substantially abuts the one or two header jamb rebates on the bottom surface of the header jamb.

Preferably, each of the auxiliary upright jambs has a side surface, an auxiliary bottom end and one or two auxiliary rebates in the side surface extending from the auxiliary top end to the auxiliary bottom end, the one or two auxiliary rebates corresponding to the one or two header jamb rebates and having generally the same cross-section.

Preferably, the one or two upright rebates of at least one of the upright jambs and the corresponding one or two header jamb rebates define corresponding one or two door recesses.

Advantageously, when the frame assembly is assembled, the one or two upright rebates and the corresponding one or two header jamb rebates having the same cross-section substantially align to define one (door recess on one side of the frame assembly or two door recesses with one on each side of the frame assembly.

Preferably, the one or two auxiliary rebates of at least one of the one or more auxiliary upright jambs and the corresponding one or two header jamb rebates define corresponding one or two auxiliary door recesses.

Advantageously, when the frame assembly is assembled, the one or two auxiliary rebates and the corresponding one or two header jamb rebates having the same cross-section substantially align to define one auxiliary door recess on one side of the frame assembly or two auxiliary door recesses with one on each side of the frame assembly.

According to a second aspect of the present invention, there is provided a door assembly comprising a frame assembly as described in the first aspect of the present invention and one or two doors for location in the respective one or two door recesses when in a closed position.

Advantageously, when the door assembly has a door recess on either side of the frame assembly, a standard door can be located in the auxiliary door recess on a first side of the frame assembly, and an outer screen door can be located in the door recess formed on a second side of the frame assembly.

According to a third aspect of the present invention, there is provided a door assembly comprising a frame assembly as described in the first aspect of the present invention and one or two auxiliary doors for location in the respective one or two auxiliary door recesses when in a closed position.

Advantageously, when the door assembly has an auxiliary door recess on either side of the frame assembly, a standard door can be located in the auxiliary door recess on a first side of the frame assembly, and an outer screen door can be located in the auxiliary door recess formed on a second side of the frame assembly.

Thus, a need exists to overcome the problems with the prior art systems, designs, and processes as discussed above.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages all in accordance with the present invention. Advantages of embodiments of the present invention will be apparent from the following detailed description of the exemplary embodiments thereof, which description should be considered in conjunction with the accompanying drawings in which.

DETAILED DESCRIPTION OF THE INVENTION

Figure 1A:
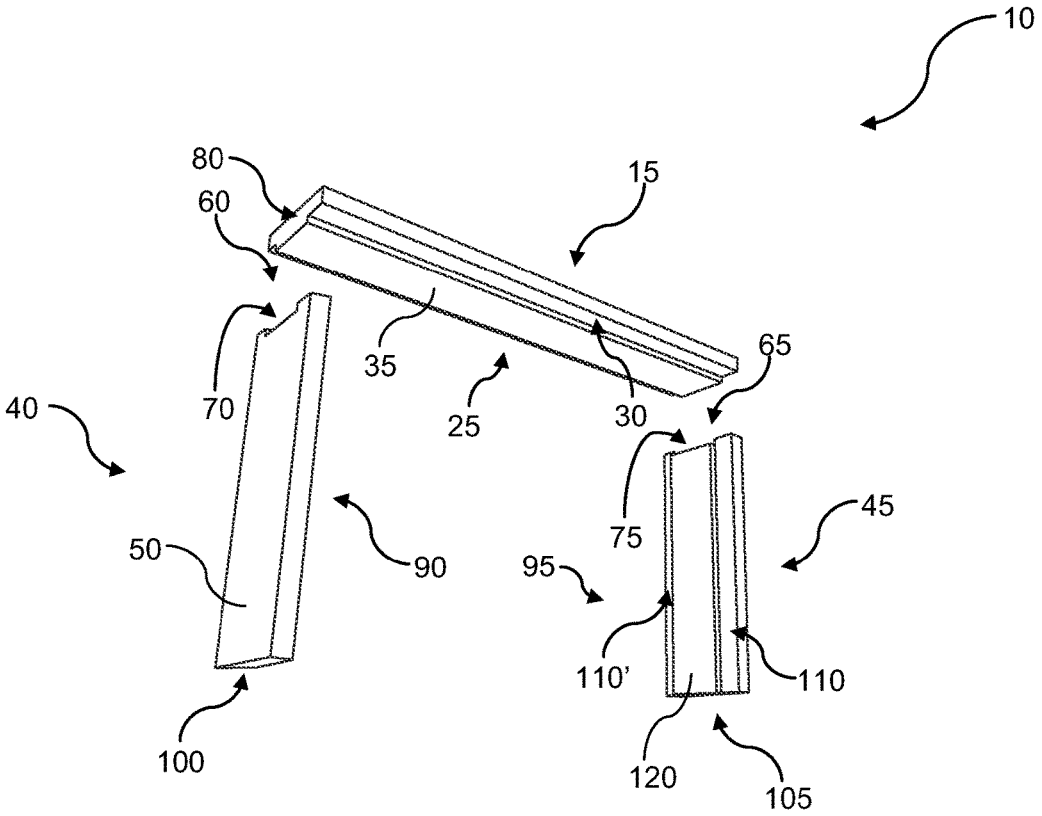
FIG. 1 is a perspective view of a frame assembly for a doorway, shown in (a) exploded form and (b) assembled form, in accordance with a preferred embodiment of the present invention.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

Alternate embodiments may be devised without departing from the spirit or the scope of the invention. Additionally, well-known elements of exemplary embodiments of the invention will not be described in detail or will be omitted so as not to obscure the relevant details of the invention.

Before the present invention is disclosed and described, it is to be understood that the terminology used herein is for the purpose of describing particular embodiments only and is not intended to be limiting. The terms "a" or "an", as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

Relational terms such as first and second, top and bottom, and the like may be used solely to distinguish one entity or action from another entity or action without necessarily requiring or implying any actual such relationship or order between such entities or actions. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Herein various embodiments of the present invention are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

It should be noted in the following description that like or the same reference numerals in different embodiments denote the same or similar features.

Figure 1B:
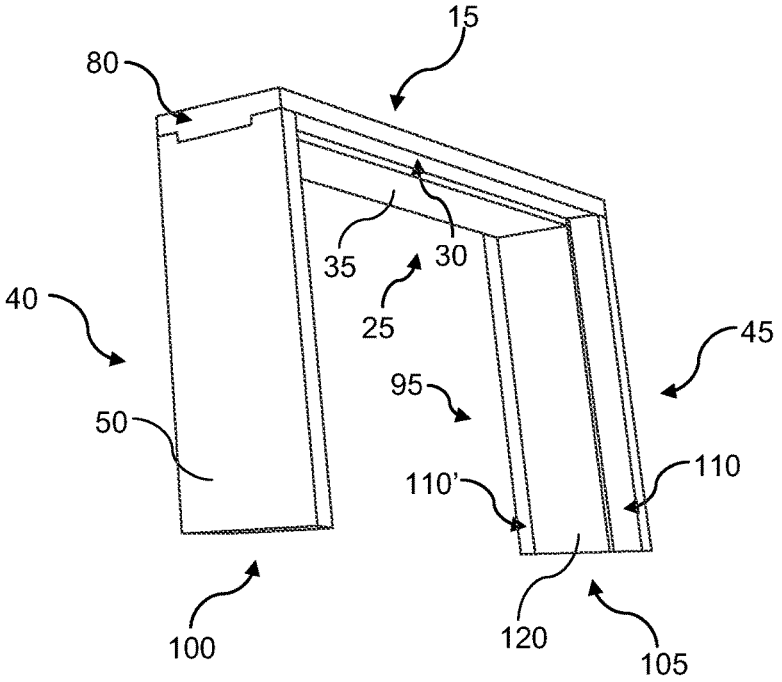
Figure 2A:
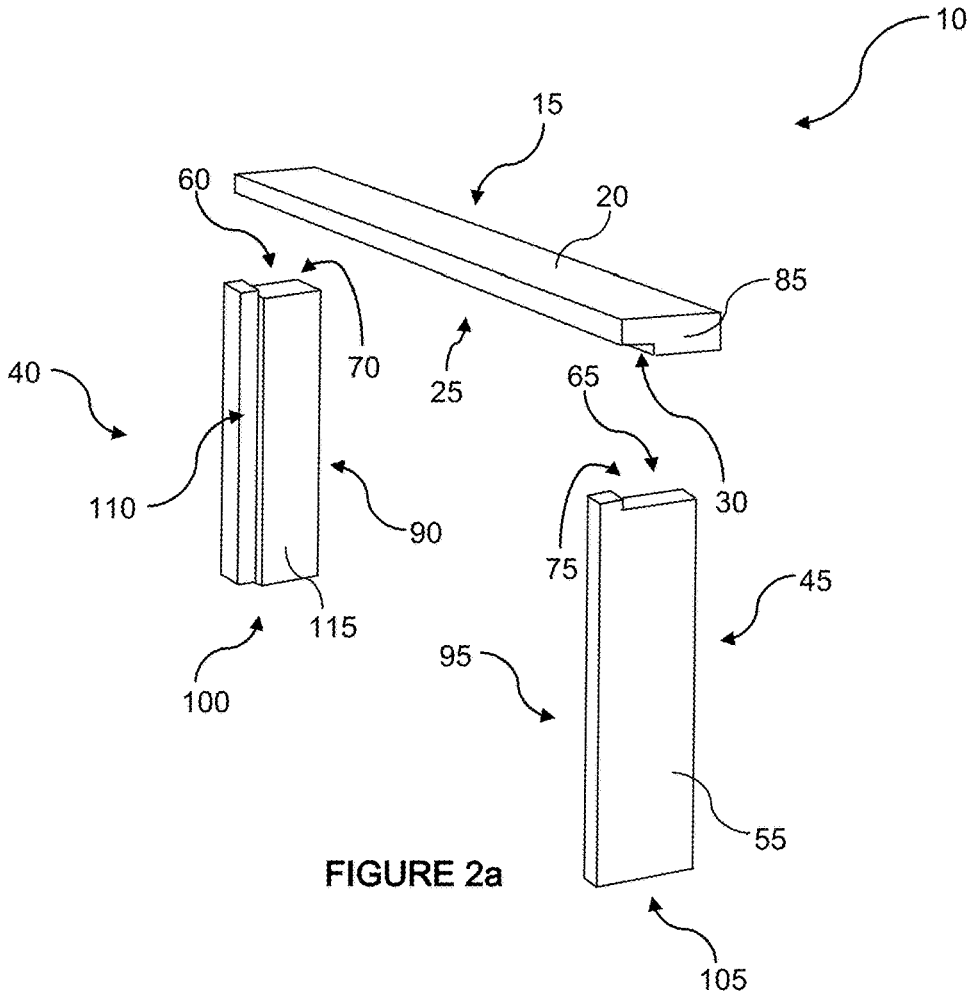
FIG. 2 is a perspective view of a frame assembly for a doorway shown in (a) exploded form and (b) assembled form, in accordance with another preferred embodiment of the present invention.
Figure 2B:
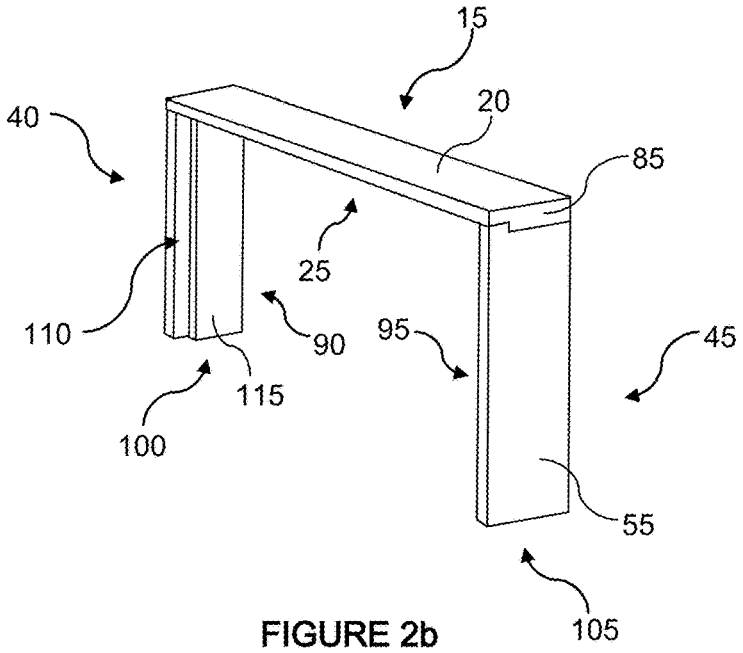

According to a first embodiment of the present invention, and as schematically shown in FIGS. 1 to 2, there is provided a frame assembly 10 for a doorway (not shown), the doorway being defined by two substantially vertical sides and a substantially horizontal side, comprising: a header jamb 15 having a top surface 20, a bottom surface, as generally indicated by reference numeral 25, and one or two header jamb rebates 30, 30', the top surface 20 of the header jamb 15 being adapted for fixedly mounting to the substantially horizontal side of the doorway and the one or two header jamb rebates 30, 30' located on the bottom surface 25 across the length of the header jamb 15 defining a header soffit 35; and two upright jambs 40, 45 each having an outer surface 50, 55 and a top end 60, 65, the outer surface 50, 55 of each of the upright jambs 40, 45 being adapted for fixedly mounting to one of the two substantially vertical sides of the doorway, the top end 60, 65 of each of the upright jambs 40, 45 having a slot 70, 75 for receiving a portion of the header soffit 35 such that when assembled, the header soffit 35 engages in the slots 70, 75.

In this embodiment, the header jamb 15 and the two upright jambs 40, 45 can be provided as a single jamb cut with one or two rebates as required and then cut to the appropriate lengths of the header jamb 15 and the two upright jambs 40, 45 according to the dimensions of the doorway. This is beneficial as the frame assembly 10 can be provided as a single jamb rather than as three separate jambs (the header jamb 15 and the two upright jambs 40, 45) as is the case for standard frame assemblies for doorways. The header jamb 15 in FIG. 1 has two header jamb rebates 30, 30', a so-called double rebate, while the header jamb 15 in FIG. 2 has one header rebate 30, a so-called single rebate. It will be appreciated that the header jamb rebates 30, 30' can be cut to any suitable size as is required for the particular frame assembly 10.

As shown in FIGS. 1 to 2, each of the slots 70, 75 has been cut in the corresponding top end 60, 65 of the upright jambs 40, 45 such that it has the same dimensions as the header soffit 35 such that when assembled, the portion of the header soffit 35, being portions at the two respective ends 80, 85 of the header jamb 15, engage in the respective slots 70, 75 such that the top ends 60, 65 of the upright jambs 40, 45 substantially abut the one or two header jamb rebates 30, 30' on the bottom surface 25 of the header jamb 15 to afford a seamless connection with the two upright jambs 40, 45 without additional rebates needed to be cut in the header jamb 15 onsite as is often required for standard frame assemblies for doorways. The slots 70, 75 can be cut in the corresponding top ends 60, 65 of the upright jambs 40, 45 using any suitable cutting tool prior to assembling the frame assembly 10 in the doorway. Such cutting tools include, but are not limited to, a router, a saw, a chisel. Knowing the dimensions of the header soffit 35 ensures that the slots 70, 75 can be cut accurately to afford a snug fit.

The length of the header jamb 15 is such that each of the respective ends 80, 85 of the header jamb 15 lies flush with the outer surface 50, 55 of the corresponding upright jamb 40, 45. Although, it will be appreciated that in other embodiments, the respective ends 80, 85 of the header jamb 15 may extend beyond the outer surface 50, 55 of the corresponding upright jamb 40, 45 into the corresponding substantially vertical sides of the doorway. In this respect, the header jamb 15 is supported by the two upright jambs 40, 45 and the substantially vertical sides of the doorway.

In this embodiment, in the event the doorway is required to be widened, to, for example, allow for wheelchair access, the frame assembly 10 can be easily disassembled, and one or both of the same upright jambs 40, 45 repositioned in the widened doorway, such that all that is required is a longer header jamb 15 to be introduced. This is beneficial as the longer header jamb 15 can be mounted quickly and easily on the repositioned upright jambs 40, 45 onsite without needing to prepare additional header rebates in the bottom surface 25 of the header jamb 15. Similarly, in the event the doorway is required to be narrowed, the frame assembly 10 can be easily disassembled, and one or both of the same upright jambs 40, 45 can be repositioned in the narrowed doorway, such that all that is required is a shorter header jamb 15 to be introduced. This is beneficial as the same header jamb 15 can be shortened, for example, by cutting with a saw, and then re-mounted quickly and easily on the repositioned upright jambs 40, 45 onsite without needing to prepare additional header rebates in the bottom surface 25 of the header jamb 15.

In this embodiment, each of the upright jambs 40, 45 has an inner surface, as generally indicated by reference numerals 90, 95, a bottom end 100, 105, and one or two upright rebates 110, 110' in the inner surface 90, 95 extending from the top end 60, 65 to the bottom end 100, 105, the one or two upright rebates 110, 110' corresponding to the one or two header jamb rebates 30, 30' and having generally the same cross-section. As shown in FIG. 1, the upright jambs 40, 45 have a double rebate, while in FIG. 2, the upright jambs 40, 45 have a single rebate. The one or two upright rebates 110, 110' of each upright jamb 40, 45 in FIGS. 1 to 2 define upright soffits 115, 120 extending from the top end 60, 65 to the bottom end 100, 105 of the corresponding upright jamb 40, 45.

As shown in FIGS. 1 to 2, the one or two upright rebates 110, 110' of at least one of the upright jambs 40, 45 and the corresponding one or two header jamb rebates 30, 30' define corresponding one or two door recesses when substantially aligned, depending on the number of header jamb rebates 30, 30' and upright rebates 110, 110'.

In this embodiment, as the header jamb 15 and upright jambs 40, 45 are cut from the same single jamb, the one or two header jamb rebates 30, 30' and the corresponding one or two upright rebates 110, 110' have the same cross-section such that when the frame assembly 10 is assembled, the one or two header jamb rebates 30, 30' and the corresponding one or two upright rebates 110, 110' substantially align to define either one door recess on one side of the frame assembly 10 or two door recesses with one door recess on each side of the frame assembly 10, depending on the number of header jamb rebates 30, 30' and upright rebates 110, 110'. Referring specifically to FIG. 1, the two upright rebates 110, 110' and the corresponding two header jamb rebates 30, 30' substantially align such that the corresponding upright soffits 115, 120 and header soffit 35 substantially align to form two door recesses, with one door recess on each side of the frame assembly 10. Referring specifically to FIG. 2, the upright rebate 110 of both upright jambs 40, 45 and the corresponding header jamb rebate 30 substantially align such that the corresponding upright soffits 115, 120 and header soffit 35 substantially align to form one door recess on one side of the frame assembly 10.

In this embodiment, the frame assembly 10 further comprises one or more auxiliary upright jambs disposed between the upright jambs 40, 45, each of the one or more auxiliary upright jambs having an auxiliary top end, each of the auxiliary top ends having an auxiliary slot for receiving a portion of the header soffit 35 such that when assembled, the header soffit 35 engages in the auxiliary slots. The one or more auxiliary upright jambs can be easily introduced into the frame assembly 10 to, for example, divide the frame assembly 10 into two or more openings. This is beneficial if, for example, two or more auxiliary doors are to be installed in the frame assembly 10, or alternatively, if, for example, an auxiliary door is to be introduced into one of the two or more openings and either a leadlight (not shown) or a solid panel (not shown) is to be installed into the other of the two or more openings.

Figure 3A:
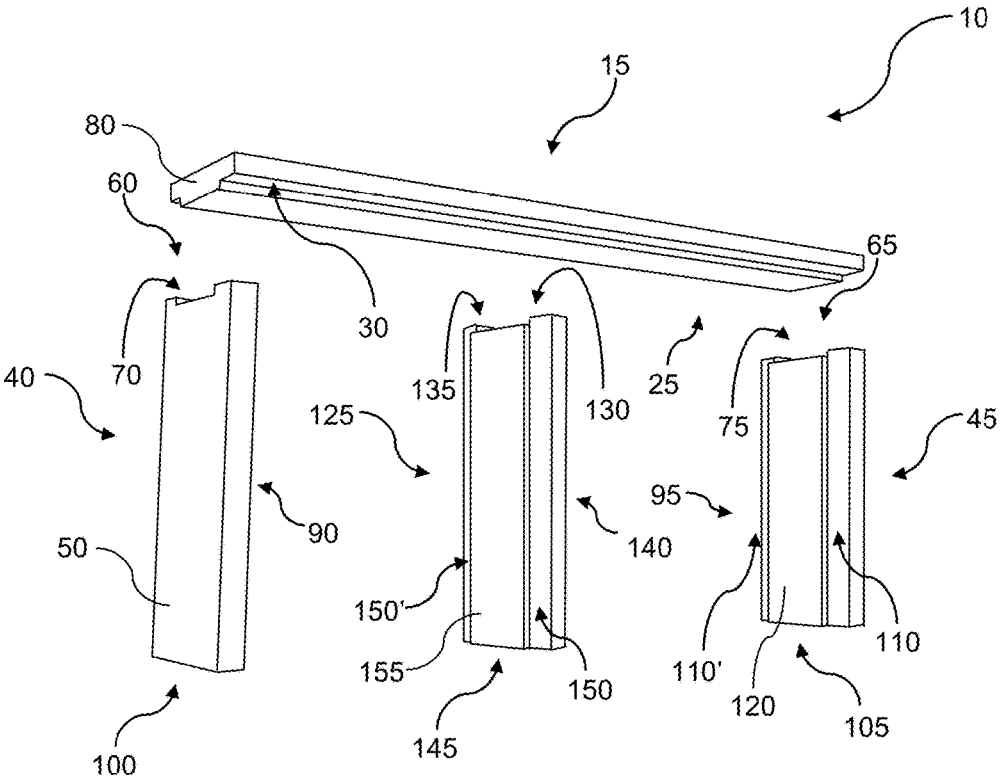
FIG. 3 is a perspective view of the frame assembly of FIG. 1 further comprising an auxiliary upright jamb, shown in (a) exploded form and (b) assembled form.
Figure 3B:
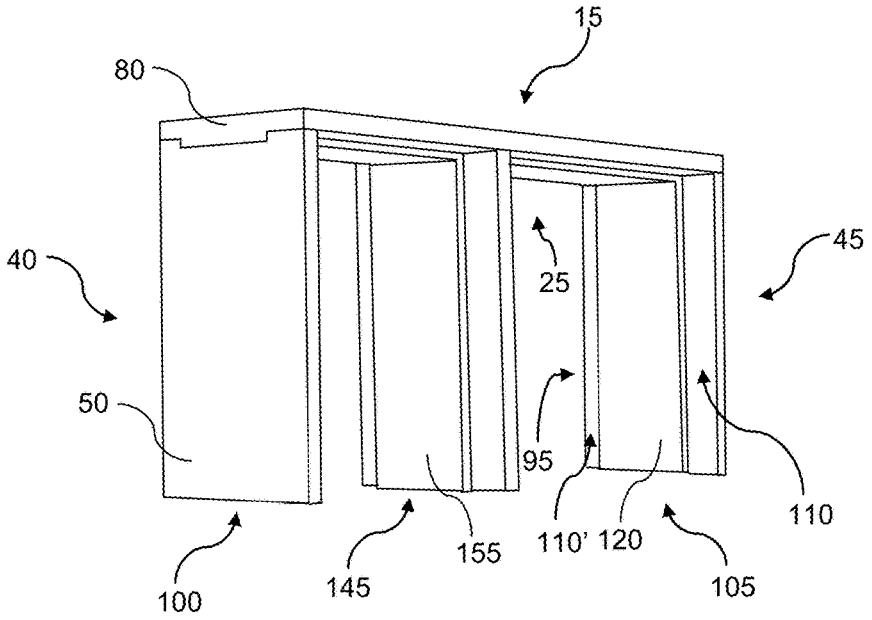
Figure 4A:
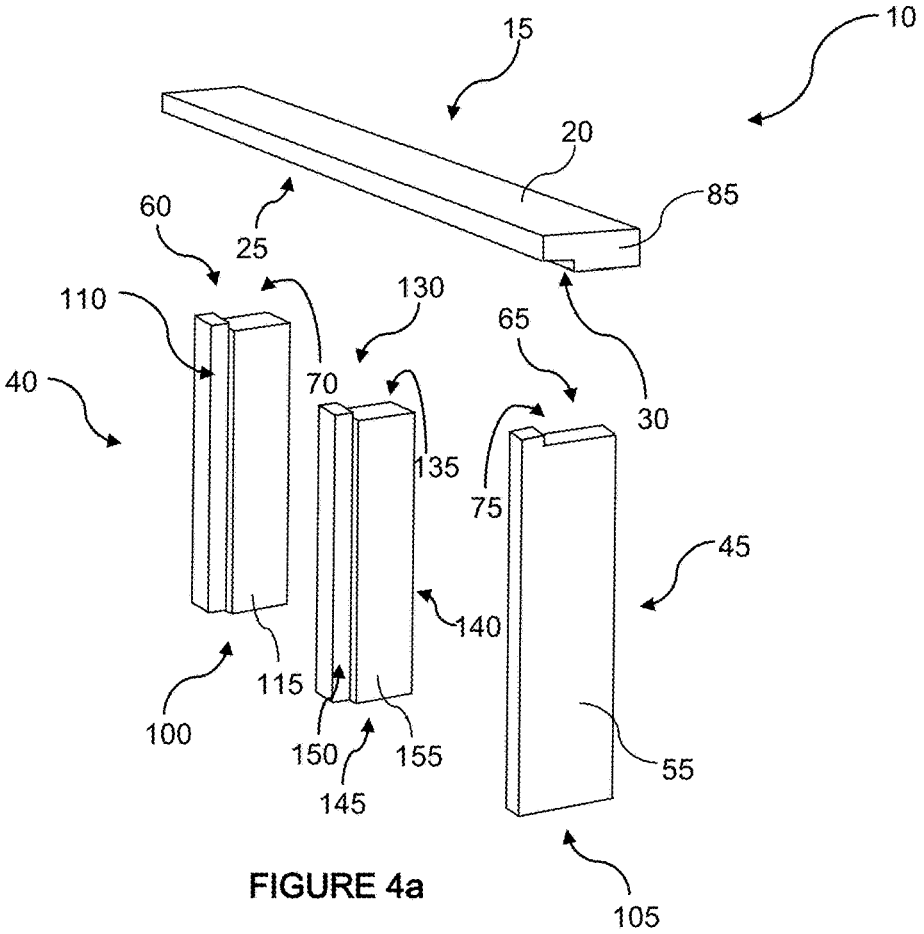
FIG. 4 is a perspective view of the frame assembly of FIG. 2 further comprising an auxiliary upright jamb, shown in (a) exploded form and (b) assembled form.
Figure 4B:
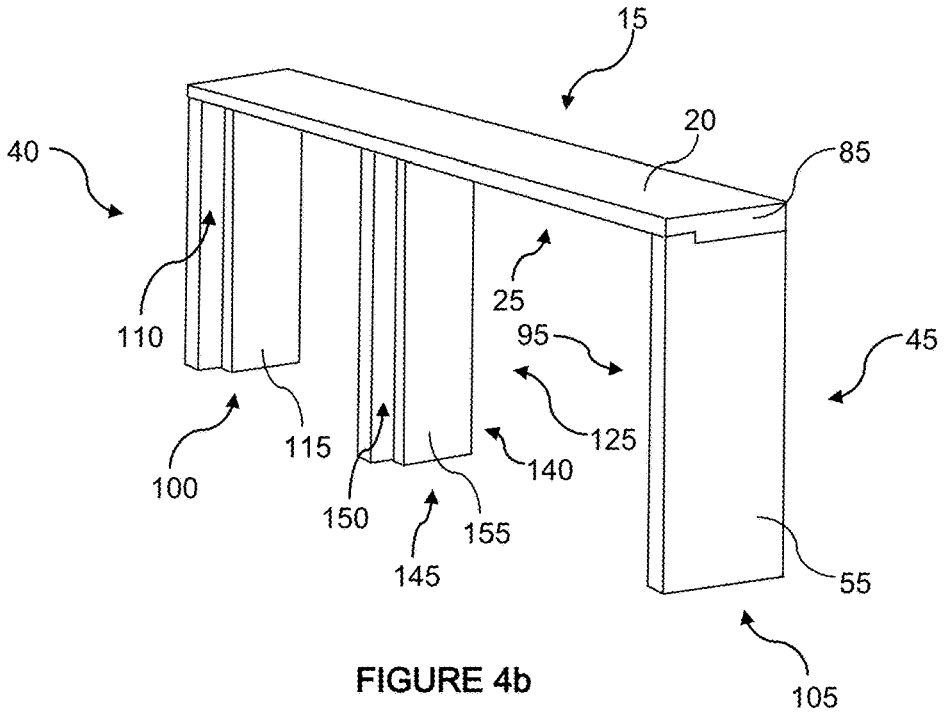

As shown in FIGS. 3 to 4, the one or more auxiliary upright jambs are one auxiliary upright jamb 125 having an auxiliary top end 130 and an auxiliary slot 135 cut in the auxiliary top end 130. The auxiliary slot 135 has the same dimensions as the header soffit 35 of the header jamb 15 such that when assembled, the auxiliary slot 135 receives the portion of the header soffit 35 and the auxiliary top end 130 of the auxiliary upright jamb 125 substantially abuts the one or two header jamb rebates 30, 30' on the bottom surface 25 of the header jamb 15 to afford a seamless connection with the auxiliary upright jamb 125. In this respect, and as shown in FIGS. 3 to 4, the auxiliary upright jamb 125 divides the frame assembly 10 into a pair of openings. As shown in FIGS. 3 to 4, the auxiliary upright jamb 125 has a side surface, as generally indicated by reference numeral 140, an auxiliary bottom end 145, and one or two auxiliary rebates 150, 150' in the side surface 140 extending from the auxiliary top end 130 to the auxiliary bottom end 145, the one or two auxiliary rebates 150, 150' corresponding to the one or two header jamb rebates 30, 30' and having generally the same cross-section. As shown in FIG. 3, the auxiliary upright jamb 125 has two auxiliary rebates 150, 150', the so-called double rebate, while in FIG. 4 the auxiliary upright jamb 125 has one auxiliary rebate 150, the so-called single rebate. Referring specifically to FIG. 3, the auxiliary rebates 150, 150' define an auxiliary upright soffit 155 extending from the top end 130 to the bottom end 145 of the auxiliary upright jamb 125. Referring specifically to FIG. 4, the auxiliary upright rebate 150 defines an auxiliary upright soffit 155 extending from the top end 130 to the bottom end 145 of the auxiliary upright jamb 125.

As shown in FIGS. 3 to 4, the one or two auxiliary rebates 150, 150' of the auxiliary upright jamb 125 and the corresponding one or two header jamb rebates 30, 30' define corresponding one or two auxiliary door recesses, depending on the number of header jamb rebates 30, 30', upright rebates 110, 110' and auxiliary rebates 150, 150'. In this embodiment, as the header jamb 15, upright jambs 40, 45, and auxiliary upright jamb 125 are cut from the same single jamb, the corresponding one or two header jamb rebates 30, 30', the corresponding one or two upright rebates 110, 110', and the corresponding one or two auxiliary rebates 150, 150' have the same cross-section such that when the frame assembly 10 is assembled, the corresponding one or two auxiliary rebates 150, 150', the corresponding one or two header jamb rebates 30, 30' and the corresponding one or two upright rebates 110, 110' of one of the two upright jambs 40, 45 substantially align to define either one auxiliary door recess on one side of the frame assembly 10 or two auxiliary door recesses, with one auxiliary door recess on each side of the frame assembly 10, depending on the number of auxiliary rebates 150, 150', header jamb rebates 30, 30' and upright rebates 110, 110'. In this embodiment, it will be appreciated that as the one or two auxiliary rebates 150, 150' are only in the side surface 140 of the auxiliary upright jamb 125, the corresponding one or two auxiliary door recesses are defined by the one or two auxiliary rebates 150, 150', the corresponding one or two header jamb rebates 30, 30' and the corresponding one or two upright rebates 110, 110' of the one upright jamb 40, 45 in one of the pair of openings in the frame assembly 10, the one opening being that in which the one or two auxiliary rebates 150, 150' of the auxiliary upright jamb 125 and the one or two upright rebates 110, 110' of the corresponding upright jamb 40, 45 are facing toward each other.

Referring specifically to FIG. 3, the two auxiliary rebates 150, 150', the corresponding two header jamb rebates 30, 30', and corresponding two upright rebates 110, 110' of one of the upright jambs 40 substantially align such that the corresponding auxiliary upright soffit 155, header soffit 35 and upright soffit 115 substantially align to form two auxiliary door recesses, with one auxiliary door recess on each side of the frame assembly 10.

Referring specifically to FIG. 4, the auxiliary rebate 150, the corresponding header jamb rebate 30, and the corresponding upright rebate 110 of one of the upright jambs 45 substantially align such that the corresponding auxiliary upright soffit 155, header soffit 35 and upright soffit 120 substantially align to form a auxiliary door recess on one side of the frame assembly 10.

Figure 5:
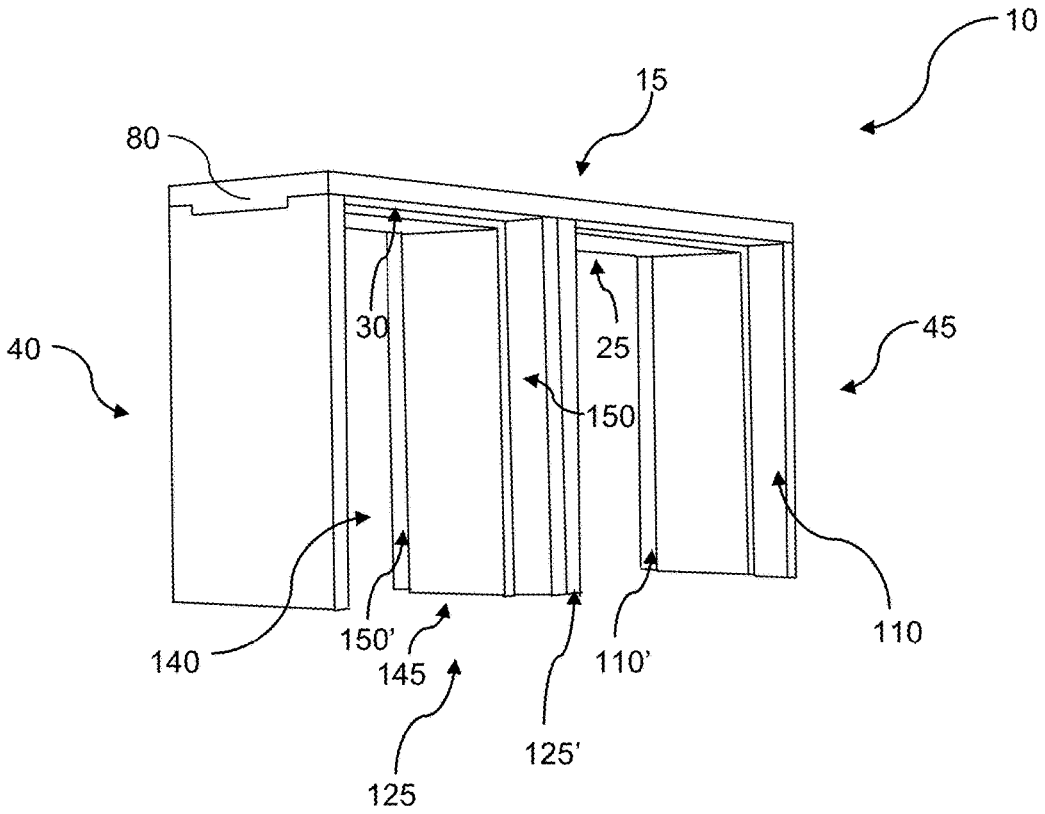
FIG. 5 is a perspective view of the frame assembly of FIG. 3 further comprising a second auxiliary upright jamb, shown in assembled form.

In another embodiment, and as shown in FIG. 5, the one or more auxiliary upright jambs of the frame assembly 10 are two auxiliary upright jambs 125, 125', each having an outer surface (not shown) and one or two auxiliary rebates 150, 150' in their respective side surfaces 140 extending from the auxiliary top end (not shown) to the auxiliary bottom end 145, the two auxiliary upright jambs 125, 125' being disposed between the upright jambs 40, 45 of the frame assembly 10 and being located adjacent one another such that their corresponding outer surfaces substantially abut. Therefore, when the frame assembly 10 is assembled, the two substantially abutting auxiliary upright jambs 125, 125' divide the frame assembly 10 into a pair of openings such that each of the two auxiliary upright jambs 125, 125', a corresponding one of the upright jambs 40, 45, and the header jamb 15 define one of the pair of openings. In this arrangement, each opening can have one or two auxiliary door recesses depending on whether the corresponding auxiliary upright jamb 125, 125', the corresponding upright jamb 40, 45, and the corresponding header jamb 15 have one or two auxiliary rebates 150, 150', one or two upright rebates 110, 110' and one or two header jamb rebates 30, (not shown), respectively.

The frame assembly for a doorway provides a number of advantages, including:

The slot in the top end of each upright jamb enables the header jamb to be mounted quickly and easily on the upright jambs onsite without needing to prepare additional header rebates in the bottom surface of the header jamb to receive the upright jambs as is required with a standard frame assembly for a doorway.

The slot in the top end of each upright jamb receives a portion of the header soffit such that the top end of the upright jamb substantially abuts the one or two header jamb rebates on the bottom surface of the header jamb.

In the event the doorway is required to be widened, the frame assembly can be easily disassembled, and the same upright jambs repositioned in the widened doorway, such that all that is required is a longer header jamb to be introduced. This is beneficial as the longer header jamb can be mounted quickly and easily on the repositioned upright jambs onsite without needing to prepare additional header rebates in the bottom surface of the header jamb.

In the event the doorway is required to be narrowed, the frame assembly can be easily disassembled, and the same upright jambs can be repositioned in the narrowed doorway, such that all is required is a shorter header jamb to be introduced. This is beneficial as the same header jamb can be shortened and then re-mounted quickly and easily on the repositioned upright jambs onsite without needing to prepare additional header rebates in the bottom surface of the header jamb.

The header jamb and the two upright jambs can be provided as a single jamb cut with one or two rebates as is required and then cut onsite to the appropriate lengths of the header jamb and the two upright jambs according to the dimensions of the doorway. This is beneficial as the frame assembly can be manufactured and provided as a single jamb rather than as a set of three separate jambs as is the case with conventional frame assemblies for doorways.

One or more auxiliary upright jambs can be easily introduced to the frame assembly to, for example, divide the frame assembly into two or more openings. This is beneficial if, for example, two or more auxiliary doors are to be installed in the frame assembly, or alternatively, if, for example, an auxiliary door is to be introduced into one of the two or more openings and either a leadlight (not shown) or a solid panel (not shown) is to be installed in the other of the two or more openings.

The auxiliary slot in the auxiliary top end of each of the one or more auxiliary upright jambs receives a portion of the header soffit such that the auxiliary top end of each of the one or more auxiliary upright jambs substantially abuts the one or two header jamb rebates on the bottom surface of the header jamb.

When the frame assembly is assembled, the one or two upright rebates and the corresponding one or two header jamb rebates having the same cross-section substantially align to define one door recess on a first side of the frame assembly or two door recesses with one on each side of the frame assembly.

When the frame assembly is assembled, the one or two auxiliary rebates and the corresponding one or two header jamb rebates having the same cross-section substantially align to define one door recess on one a first side of the frame assembly or two door recesses with one on each side of the frame assembly.

Figure 6A:
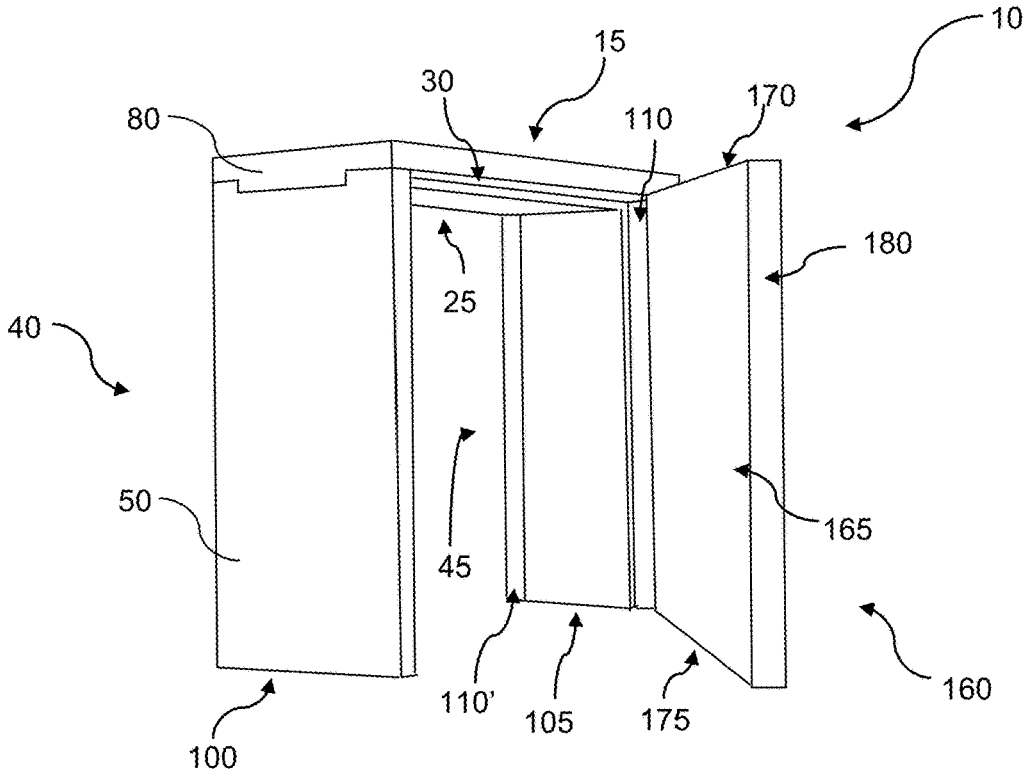
FIG. 6 is a perspective view of a door assembly, comprising the frame assembly of FIG. 1, and a door, shown in (a) an open position and (b) a closed position.
Figure 6B:
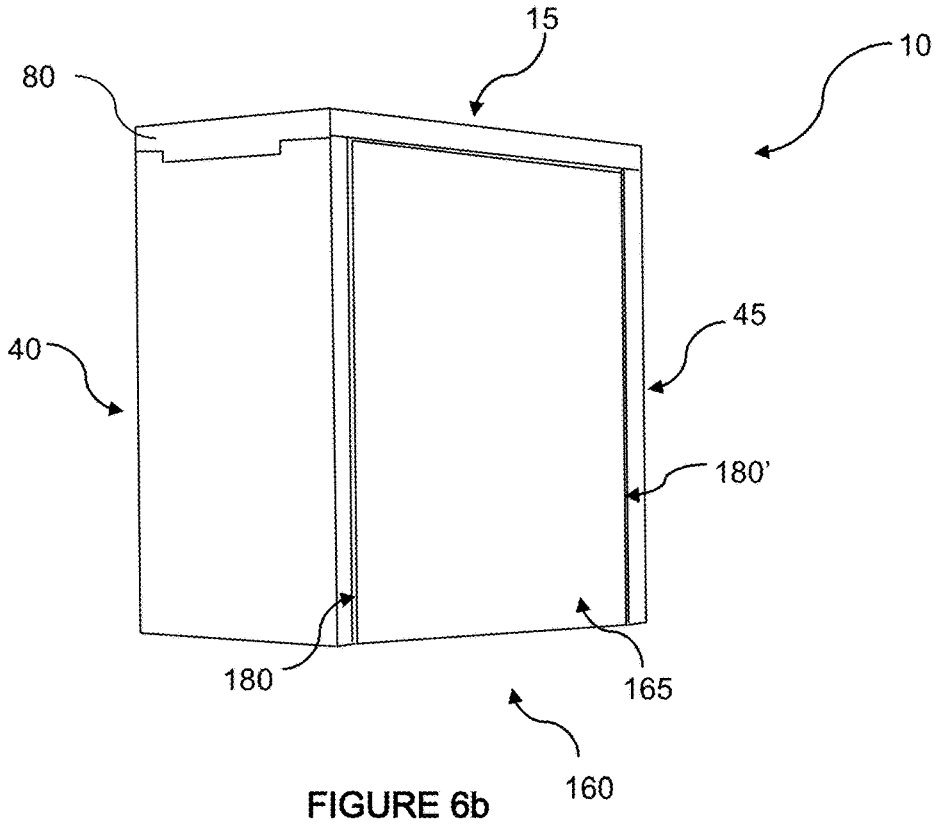

According to a second embodiment of the present invention, and as shown in FIG. 6, there is provided a door assembly 160, comprising: a frame assembly 10 as described in the first embodiment of the present invention; and one or two doors 165, (not shown) for location in the respective one or two door recesses (not shown) when in a closed position. The one or two doors 165 each have a top end 170, a bottom end 175, and a pair of opposing upright ends 180, 180' located between the top end 170 and the bottom end 175. The one or two doors 165 may be any type of door, such as, for example, a panel door, a plank door, a batten door, a flush door, an outer screen door, or a molded door.

In this embodiment, the door assembly 160 can thus be configured to have either one door recess on one side of the frame assembly 10 or two door recesses, with one door recess on each side of the frame assembly 10, depending on the number of header jamb rebates 30, (not shown) and upright rebates 110, 110'. Each of the one or two door recesses is thus configured for location of a door 165 therein.

In this embodiment, at least one of the one or two doors 165 is adapted for hingedly mounting to one of the two upright jambs 40, 45. As shown in FIG. 6, for a door assembly 160 in which the opening in the frame assembly 10 is configured with two door recesses, the upright rebate 110 of one of the two upright jambs 45 associated with one of the two door recesses and one of the pair of opposing upright ends 180' of the at least one door 165 each comprise a hinge rebate (not shown) to receive a hinge (not shown) therein for hingedly mounting the at least one door 165 to the one upright jamb 45. The at least one door 165 is thus configured for moving about the hinged mounting in an arc between an open position, corresponding to a first side of the frame assembly 10 and the closed position where the at least one door 165 is located within the door recess. It will be appreciated that in this case, the at least one door 165 is prevented from rotating completely through the opening in the frame assembly 10 about its hinged mounting by the corresponding door recess on the first side of the frame assembly 10, which the at least one door 165 engages when in the closed position.

The other of the one or two doors (not shown) can be adapted for hingedly mounting to either the other upright rebate 110' of the same upright jamb 45 as that used for hingedly mounting the at least one door 165 to, or to the upright rebate 110' of the other of the two upright jambs 40 associated with the other of the one or two door recesses. It will be appreciated that the other of the one or two doors is hingedly mounted to the upright rebate 110' of the corresponding upright jamb 40, 45 using a hinge as described above. In both cases, the other of the one or two doors is thus configured for moving about the hinged mounting in an arc between an open position, corresponding to a second side of the frame assembly 10 and the closed position where the other of the one or two doors is located within the other of the one or two door recesses. In this arrangement, for example, a standard door 165 can be received in one of the one or two door recesses on the first side of the frame assembly 10, and an outer screen door can be received in the other of the one or two door recesses formed in the second side of the frame assembly 10. It will be appreciated that the choice of which of the two upright jambs 40, 45, the one or two doors 165 are hingedly mounted to within their respective door recesses may depend on any one of a number of factors, including, but not limited to, user preference, structural design, structural limitations of the immediate vicinity around the door assembly 160.

In this embodiment, the door assembly 160 further comprises a lock (not shown) for releasably locking at least one of the one or two doors 165 in the respective door recess when in the closed position. The lock may be any type of lock known in the locksmith trade for locking doors, including, but not limited to, any one of the following: a mortise lock, a lock bolt, an entry lock, or a deadbolt lock. In one example, the lock is a mortise lock comprising a first lock portion (not shown) such as a lock body located in a mortise (not shown) cut into one of the pair of opposing upright ends 180, 180' of the at least one door 165, and a complementary second lock portion (not shown) such as a strike plate located in the upright rebate 110 of the corresponding upright jamb 40. The first lock portion and the complementary second lock portion are adapted to releasably engage each other to releasably lock the at least one door 165 in the closed position. The lock further comprises a lock trim such as a door handle (not shown) located in the at least one door 165, the lock trim being operatively connected to the first lock portion and being configurable between a locked position where the first lock portion engages the second lock portion to lock the at least one door 165 when in the closed position, and an unlocked position where the first lock portion releases from the second lock portion to unlock the at least one door 165 and enabling it to move about the hinged mounting to the open position. In another example, the bolt is located in the bottom end 175 of the at least one door 165, and the complementary strike plate is located in the portion of the floor superposed below the at least one door 165. Alternatively, or additionally, the lock may be adapted for releasably locking the at least one door 165 to a portion of the header jamb 15 substantially superposed above the at least one door 165. In this case, the first lock portion is located in the top end 170 of the at least one door 165 and the complementary second lock portion (not shown) is located in the portion of the header jamb 15 superposed above the at least one door 165. The lock increases the security of the doorway when the at least one door 165 remains in the closed position.

In other embodiments, it will be appreciated that the one or two door recesses are not limited to being configured for location of just one door 165 therein, but they may be configured for location of more than one door therein. For example, at least one of the one or two door recesses may be configured for location of a pair of doors (not shown) therein. In this example, each door of the pair of doors is adapted for hingedly mounting to the upright rebate 110, 110' of a corresponding one of the two upright jambs 40, 45 associated with the at least one of the one or two door recesses. In this arrangement, each door of the pair of doors is thus configured for moving about their respective hinged mounting to the corresponding upright jamb 40, 45 in an arc between an open position and the closed position where each door of the pair of doors is located within the at least one of the one or two door recesses.

According to a third embodiment of the present invention, there is provided a door assembly 160, comprising: a frame assembly 10 as described in the first embodiment of the present invention; and one or two auxiliary doors 185, (not shown) for location in the respective one or two auxiliary door recesses when in a closed position. The one or two auxiliary doors 185 each have a top end 190, a bottom end 195, and a pair of opposing upright ends 200, 200', located between the top end 190 and the bottom end 195. The one or two auxiliary doors 185 may be any type of auxiliary door, such as, for example, a panel door, a plank door, a batten door, a flush door, an outer screen door, or a molded door. The door assembly 160 can be configured with either one auxiliary door recess on one side of the frame assembly 10 or two auxiliary door recesses, with one auxiliary door recess on each side of the frame assembly 10, depending on the number of header jamb rebates 30, (not shown), auxiliary rebates 150, 150' and upright rebates 110, 110' defining the corresponding auxiliary door recesses. The one or more auxiliary upright jambs 125 of the frame assembly 10 divide the frame assembly 10 into two or more openings. This is beneficial if, for example, two or more auxiliary doors are to be installed in the frame assembly 10, or alternatively, if, for example, an auxiliary door is to be introduced into one of the two or more openings and either a leadlight (not shown) or a solid panel (not shown) is to be installed into the other of the two or more openings.

Figure 7A:
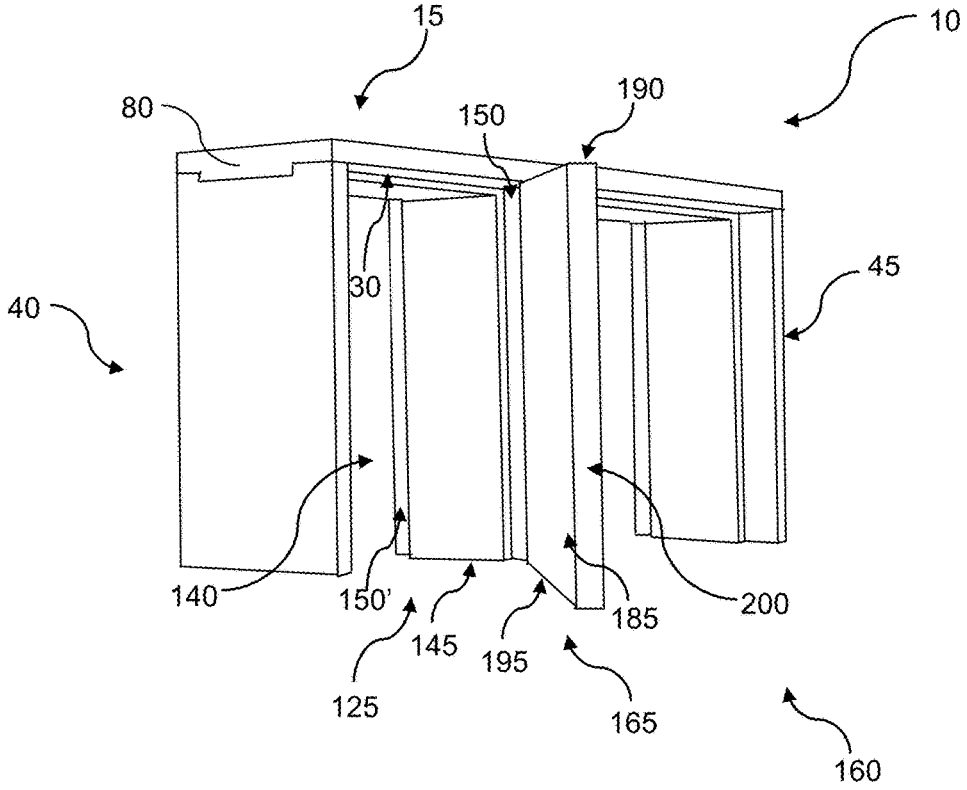
FIG. 7 is a perspective view of a door assembly, comprising the frame assembly of FIG. 3, and an auxiliary door shown in (a) an open position and (b) a closed position.
Figure 7B:
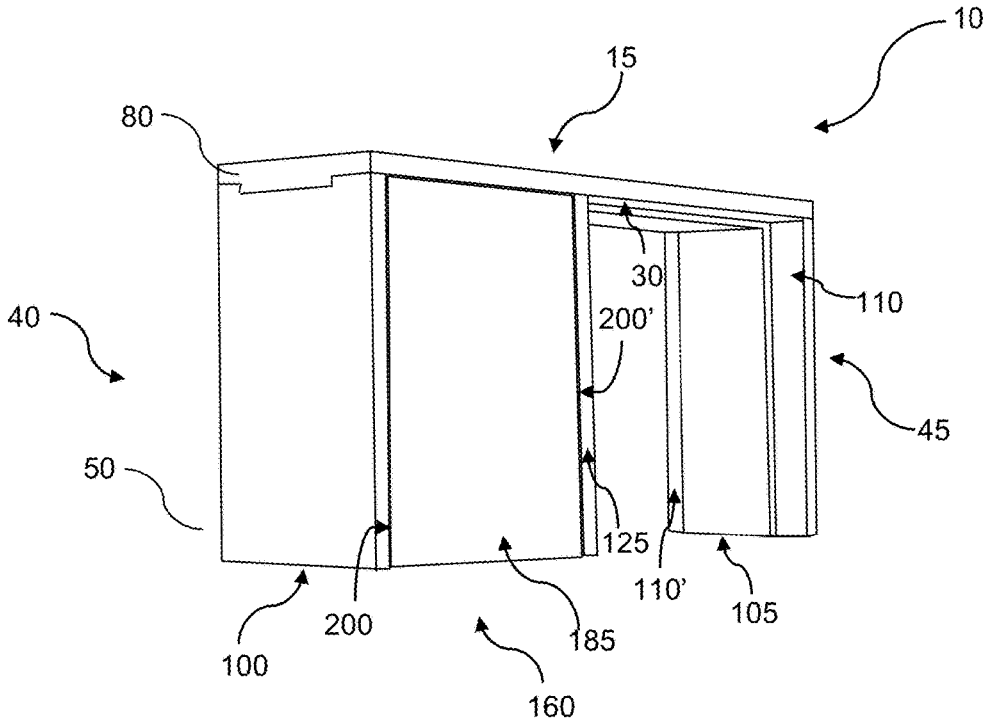

In one embodiment, and as shown in FIG. 7, the one or more auxiliary upright jambs are one auxiliary upright jamb 125, as described in the first embodiment of the present invention. In this case, the one auxiliary upright jamb 125 divides the frame assembly 10 into a pair of openings, with at least one opening of the pair of openings having one or two auxiliary door recesses. Again, it will be appreciated that if the header jamb 15, upright jambs 110, 110', and auxiliary upright jamb 125 are cut from the same single jamb, then the one or two auxiliary rebates 150, 150' are only located in the side surface 140 of the auxiliary upright jamb 125. As such, the one or two auxiliary door recesses are defined by the one or two auxiliary rebates 150, 150' of the auxiliary upright jamb 125, the corresponding one or two header jamb rebates 30, (not shown) of the header jamb 15, and the corresponding one or two upright rebates 110, 110' of the one upright jamb 40 in one opening of the pair of openings in the frame assembly 10, the opening being that in which the one or two auxiliary rebates 150, 150' of the auxiliary upright jamb 125 and the one or two upright rebates 110, 110' of the one upright jamb 40 are facing toward each other. Referring specifically to FIG. 7, the auxiliary door 185 is shown being hingedly mounted to the auxiliary upright jamb 125, however, it will be appreciated that the one or two auxiliary doors 185 can be hingedly mounted to either the auxiliary upright jamb 125 or to the corresponding upright jamb 40 associated with the auxiliary door recess in the corresponding opening of the pair of openings. In either arrangement, it will be appreciated that in one example, one of the one or two auxiliary doors 185 can be a standard door for location in the auxiliary door recess on a first side of the frame assembly 10, and the other of the one or two auxiliary doors (not shown) can be an outer screen door for location in the auxiliary door recess formed in a second side of the frame assembly 10. It will be appreciated that the choice of which of the two upright jambs 40, 45, or auxiliary upright jamb 125 the one or two auxiliary doors 185 are hingedly mounted to within their respective auxiliary door recesses may depend on any one of a number of factors, including, but not limited to, user preference, structural design, structural limitations of the immediate vicinity around the door assembly 160.

In other embodiments, it will be appreciated that by introducing two auxiliary upright jambs 125, (not shown), each having one or two auxiliary rebates 150, 150', into the frame assembly 10 such that their corresponding outer surfaces (not shown) substantially abut one another, the door assembly 160 can be configured with a pair of openings in which each opening can have one or two auxiliary door recesses for receiving one or two respective auxiliary doors 185 when in the closed position.

The door assembly provides a number of advantages. First, when the door assembly has a door recess on either side of the frame assembly, a standard door can be located in the auxiliary door recess on a first side of the frame assembly, and an outer screen door can be located in the door recess formed on a second side of the frame assembly. Second, when the door assembly has an auxiliary door recess on either side of the frame assembly, a standard door can be located in the auxiliary door recess on a first side of the frame assembly, and an outer screen door can be located in the auxiliary door recess formed on a second side of the frame assembly.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly, it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the carpentry industry, the construction industry and civil engineering in general.

What is claimed is:

1. A kit of disassembled door frame parts that assemble to form a slidably adjustable frame assembly for sizing to fit different sized doorway openings, comprising:

a header jamb consisting of, as a single piece, a top surface that is flat and continuous, a bottom surface that is longitudinally continuous, and one or two header jamb rebates extending a length of the header jamb, the top surface of the header jamb being adapted for fixedly mounting to the substantially horizontal side of the doorway, the one or two header jamb rebates located on the bottom surface across the length of the header jamb, the bottom surface defining a header soffit extending the length of the header jamb; and two upright jambs each consisting of, as a single piece, an outer surface and a top end, the outer surface of each of the upright jambs being adapted for fixedly mounting to one of the two substantially vertical sides of the doorway, the header jamb and the upright jambs being substantially the same in profile and construction and constructed of continuous lengths, wherein each of the upright jambs has an inner surface, a bottom end, and one or two upright rebates in the inner surface extending from the top end to the bottom end, the one or two upright rebates corresponding to the one or two header jamb rebates and having generally the same cross section, wherein the header jamb and the two upright jambs are adapted to be provided as a single jamb with the one or two rebates as required, the top end of each of the upright jambs having a slot for slidably receiving spaced apart portions of the header soffit such that in an assembled condition the header soffit engages in the slots and the upright rebates and the header jamb rebate form a continuous door recess engageable with a door when in a closed position, and wherein in an assembled condition the upright jambs are movable relative to each other over the header soffit to adjust the width of the doorway.

2. The kit according to claim 1, further comprising one or more auxiliary upright jambs, wherein in an assembled condition the one or more auxiliary upright jambs are disposed between the upright jambs, the header jamb and the upright jambs and being substantially the same in profile and construction and constructed of continuous single piece lengths of wood; each of the one or more auxiliary upright jambs consisting of an auxiliary top end with an auxiliary slot for receiving a portion of the header soffit, a side surface, an auxiliary bottom end and one or two auxiliary rebates in the side surface extending from the auxiliary top end to the auxiliary bottom end, the one or two auxiliary rebates corresponding to the one or two header jamb rebates and having generally the same cross-section such that when assembled the header soffit engages in the auxiliary slots.

3. A method for assembling a slidably adjustable frame assembly for sizing to fit different sized doorway openings comprising:

assembling the header jamb and two upright jambs and one or more auxiliary upright jambs comprising the kit according to claim 2, sliding one of the two upright jambs relative to the other over the header soffit to adjust a width of the doorway to fit the doorway opening measurements, removing excess header soffit from the assembly following adjustment substantially without disassembly of the header soffit from the uprights, and securing the uprights and optional auxiliary uprights and header soffit to the doorway.

4. The method according to claim 3, wherein the header jamb and the two upright jambs are formed as a single jamb with one or two rebates as required and cut to appropriate lengths of the header jamb and the two upright jambs and the slot formed in a top end of the two upright jambs for receiving the header soffit in the slots.

5. The method according to claim 3, wherein one or two upright rebates of at least one of the upright jambs and corresponding one or two header jamb rebates define corresponding one or two door recesses.

6. The method according to claim 3, wherein one or two auxiliary rebates of at least one of the one or more auxiliary upright jambs and corresponding one or two header jamb rebates define corresponding one or two auxiliary door recesses.

7. A slidably adjustable frame assembly assembled by the method according to claim 3.

8. A method for assembling a slidably adjustable frame assembly for sizing to fit different sized doorway openings, the method comprising:

providing the disassembled parts of the kit according to claim 1, assembling the header jamb and two upright jambs, sliding one of the two upright jambs relative to the other over the header soffit to adjust a width of the doorway to fit the doorway opening measurements, removing excess header soffit from the assembly following adjustment substantially without disassembly of the header soffit from the uprights, and securing the uprights and header soffit to the doorway.

9. A slidably adjustable frame assembly assembled by the method according to claim 8.

10. The adjustable frame assembly according to claim 9, wherein the header jamb and the two upright jambs are formed as a single jamb with one or two rebates as required and cut to appropriate lengths of the header jamb and the two upright jambs and the slot formed in a top end of the two upright jambs for receiving the header soffit in the slots.

11. The adjustable frame assembly according to claim 9, wherein one or two upright rebates of at least one of the upright jambs and corresponding one or two header jamb rebates define corresponding one or two door recesses.

* * * * *